US006523711B1

(12) United States Patent
Hughes et al.

(10) Patent No.: US 6,523,711 B1
(45) Date of Patent: Feb. 25, 2003

(54) AUTOMATIC VALVED BOTTLE CAP FOR USE WITH LIQUID CONTAINERS

(75) Inventors: Douglass E. Hughes, 3457 Iris Ct., Boulder, CO (US) 80304; Raymond G. Bryan, Reno, NV (US)

(73) Assignee: Douglass E. Hughes, Boulder, CO (US)

( * ) Notice: Subject to any disclaimer, the term of this patent is extended or adjusted under 35 U.S.C. 154(b) by 0 days.

(21) Appl. No.: 09/548,553

(22) Filed: Apr. 13, 2000

(51) Int. Cl.[7] ..... A47G 19/22

(52) U.S. Cl. ..... 220/709; 215/308; 215/309; 215/311; 215/388; 239/33; 220/705; 220/25.2; 220/714; 220/367.1

(58) Field of Search ..... 239/33; 210/282, 210/473, 477, 482, 502.1; 222/189.06, 189.1, 464.2, 481.5, 484, 528, 529, 530, 494, 212; 215/388, 308, 309, 311, 235; 220/705, 707, 708, 709, 711, 714, 716, 717, 252, 263, 367.1, 371

(56) References Cited

U.S. PATENT DOCUMENTS

| | | | | |
|---|---|---|---|---|
| 2,529,817 | A | | 11/1950 | Russell |
| 2,844,267 | A | | 7/1958 | Petriccione |
| 3,294,293 | A | | 12/1966 | Johns |
| 3,337,098 | A | | 8/1967 | Johns |
| 3,858,773 | A | | 1/1975 | Del Bon |
| 4,239,132 | A | * | 12/1980 | Mueller et al. |
| 4,408,702 | A | * | 10/1983 | Horvath |
| 4,485,963 | A | | 12/1984 | Panicci |
| 4,513,891 | A | * | 4/1985 | Hain et al. |
| 4,714,173 | A | | 12/1987 | Ruiz |
| 4,714,550 | A | * | 12/1987 | Malson et al. |
| 4,732,303 | A | * | 3/1988 | Wang |
| 4,881,668 | A | | 11/1989 | Kitterman et al. |
| 4,925,043 | A | | 5/1990 | Dinand |
| 4,991,745 | A | * | 2/1991 | Brown |
| 5,048,705 | A | * | 9/1991 | Lynd et al. |
| 5,065,909 | A | | 11/1991 | Pino et al. |
| 5,150,815 | A | | 9/1992 | Saklad |
| 5,156,335 | A | * | 10/1992 | Smith et al. |

(List continued on next page.)

*Primary Examiner*—Robin Hylton
(74) *Attorney, Agent, or Firm*—Steven C. Petersen; Hogan & Hartson LLP

(57) ABSTRACT

A sports bottle cap having a pressure differential valve is provided which allows water to flow out through the bottle cap only when the bottle is inverted and squeezed or alternatively a straw may be threaded through the pressure differential valve, thereby deactivating it, and attached to the bottle cap allowing the user to draw liquid from the bottle through the straw. In operation the bottle cap of the present invention allows the user to dispense fluid from within the bottle in two different ways. The first manner of use allows liquid to be dispensed only when the bottle containing the liquid is inverted and squeezed. Squeezing causes the pressure to increase on the inside of the bottle thereby causing the pressure differential valve to open and liquid to exit; however, when the bottle is not squeezed the pressure differential valve remains in the closed position sealing bottle. The second manner of use allows the user to convert bottle cap for use as a sports mug having a straw-like tube to draw the liquid out of bottle. This configuration is accomplished simply by threading a straw through pressure differential valve thereby disengaging the pressure differential valve, and attaching the first end of the straw to a straw receptor located within the bottle cap. The bottle cap is then attached to the bottle and the user can suck liquid out of the bottle.

13 Claims, 11 Drawing Sheets

U.S. PATENT DOCUMENTS 5,188,283 A 2/1993 Gu
5,203,468 A 4/1993 Hsu
5,240,149 A * 8/1993 Schmidt
5,242,079 A 9/1993 Stephens et al.
5,252,206 A 10/1993 Gonzalez
5,259,538 A 11/1993 Tardif
5,273,172 A 12/1993 Rossbach et al.
5,273,649 A 12/1993 Magnusson et al.
5,337,918 A * 8/1994 Wang
5,339,982 A 8/1994 Tardie
5,346,081 A 9/1994 Lin
5,361,934 A 11/1994 Spence, Jr.
5,413,230 A * 5/1995 Folter et al.
5,415,312 A 5/1995 Mueller
5,439,143 A 8/1995 Brown et al.
5,477,994 A * 12/1995 Feer et al.
D366,809 S 2/1996 Green
D367,206 S 2/1996 Green
5,509,551 A * 4/1996 Terrel, II
5,509,605 A * 4/1996 Cripe
5,518,142 A 5/1996 Lin
5,520,304 A 5/1996 Lin
D370,828 S 6/1996 Green
D371,048 S 6/1996 Green
5,545,315 A 8/1996 Lonneman
5,579,948 A 12/1996 Lin
5,609,759 A 3/1997 Nohren, Jr. et al.
D382,170 S 8/1997 Green
5,653,878 A 8/1997 Reid
5,676,289 A * 10/1997 Gross et al.
5,688,397 A * 11/1997 Malmborg
5,688,588 A * 11/1997 Cotton et al.
5,823,400 A * 10/1998 Omori et al.
D408,220 S 4/1999 Chomik
5,897,013 A 4/1999 Manganiello
5,908,126 A * 6/1999 Wang
5,919,365 A * 7/1999 Collette
6,024,102 A 2/2000 Luzenberg, Jr.
6,050,444 A * 4/2000 Sugg
6,065,635 A * 5/2000 Sullivan
6,123,219 A * 9/2000 Cornell et al.
6,142,384 A * 11/2000 Shafik
6,145,695 A * 11/2000 Garrigues
6,196,413 B1 * 3/2001 Tung
6,213,339 B1 * 4/2001 Lee

* cited by examiner

AUTOMATIC VALVED BOTTLE CAP FOR USE WITH LIQUID CONTAINERS

BACKGROUND OF THE INVENTION

1. Field of the Invention

This invention relates generally to a dual purpose dispensing cap for liquid containers. More specifically, this invention relates to a sports bottle cap having a pressure differential valve which allows water to flow out through the bottle cap only when the bottle is inverted and squeezed or alternatively a straw may be threaded through the pressure differential valve, thereby deactivating it, and attached to the bottle cap allowing the user to draw liquid from the bottle through the straw.

2. Description of the State of Art

As bottled water and staying hydrated has become more popular, the trend has led into portable water containers which serve the needs of the consumer who is frequently on the go, or travels during the day to school, work or needs to stay hydrated while driving. There are primarily three categories of containers designed for transportation. The first category consists of containers having a cap with a push-pull valve for manually opening and closing. A second and equally popular category of containers employ a straw-like tube that protrudes through the cap or closure of the container. The tube runs to the very bottom of the container and liquid is drawn from the bottle by sucking on the tube. Various versions of this type of container exist, including flexible, silicone tube tips which fold to protect from dirt and other contaminants contacting the tube while not in use. The third category of containers has a cap which simply screws on and off the bottle.

The push-pull valve is used for nearly all bike bottles, as well as bottled water containers in supermarkets designed for people on the go; however, the standard push-pull valve has a number of drawbacks that make its use difficult if not just plain undesirable. First, push-pull valves constantly require the use of the thumb and index finger to operate the valve, thereby passing germs from the user's hands to the drinking spout. Hands and fingers are almost always covered with a variety of bacteria and viruses omnipresent on everything we touch; consequently, the push-pull valve creates a dubious interface between the liquid being consumed and the user, since there is no effective way of opening it without using it as a stepping stone for spreading bacteria and other germs. Yet another drawback to the push-pull valve is that it actually requires both hands, since one hand must hold the container while the other hand operates the valve. While some users grasp the valve in their teeth to pull the valve open they eventually will have to push the valve closed which is typically accomplished by using the palm of their hand. Finally, since the push-pull valve is almost always a two-handed operation, performing typically safe activities that require at least one hand at all times, such as driving a car or bicycle, place the user at risk as they are no longer using their hands to steer their vehicle.

As a result of the drawbacks associated with push-pull valves, as discussed above, many consumers opt for the sports mug, which employs a straw-like tube that is held upright by an aperture in the bottle's closure. The outer diameter of the aperture is about the same size as the inner diameter of the straw-like tube, thus allowing the straw to fit snugly over the aperture in a stationary manner. The sports mug is generally meant to remain stationary and the user sucks on one end of the straw-like tube to draw the liquid up and out of the mug. This configuration is as popular as the push-pull style closures, but appears more in offices, schools and places where the bottle has a stable resting place. The disadvantage with all straw-like tube containers is that they are more difficult to transport when full of a liquid, since the liquid is prone to spill during travel. The disadvantages of the non-valved closure that merely caps the bottle is that it too requires two hands to screw the cap on or off the bottle and it too easily spills if the bottle is knocked over and the cap is not securely fastened. A further disadvantage of existing container styles is that each can only be used in the single manner for which it was designed. A container designed to be inverted and poured or squeezed cannot be easily used with a straw-like tube; nor can a typical sports mug with straw-like tube be inverted and poured or squeezed. The designs have evolved to be mutually exclusive. This is cumbersome since some consumers need to use the invert and squeeze version, for example, while performing a specific athletic activity such as running or kayaking, to name two of many examples, yet may prefer to use the straw-like tube design while driving or sitting at a desk. The only current solution to date is to have two different containers.

Therefore, there is a need for a single portable container which is capable of functioning in a manner similar to either that of a push-pull valve or a container having a straw. There is a further need for a container availing itself to being operated with only one hand, where the hand does not need to come into direct contact with the closure, and which is further able to be used with a straw-like tube, such as in sports mugs. Finally, the issue of being spill proof is also important. All three of the typical aforementioned containers will spill if left open. In some cases, the straw-like tube designs have no provision for keeping the liquid from spilling out if the container is knocked over. Similarly the push-pull valve and cap closures for the invert and pour or squeeze bottles will also spill if the valve is left open or the cap is left off the container.

SUMMARY OF THE INVENTION

Accordingly, it is a general object of this invention to provide a bottle cap that does not have to be touched directly in order to open or close the bottle.

Still another object of the present invention is to provide a bottle closure mechanism that allows a container to function similarly to a container having a push-pull valve as well as a straw.

A further object of the present invention is to provide a container closure which is spill proof and sanitary.

Another object of the present invention is to provide a container closure means that is simple and easy to operate.

A final object of the invention is to provide for a means to integrate a water filtering method into the operation of the container with the closure means of the present invention so that a filter may be adapted to it without changing the way in which the bottle closure functions.

Additional objects, advantages and novel features of this invention shall be set forth in part in the description that follows, and in part will become apparent to those skilled in the art upon examination of the following specification or may be learned by the practice of the invention. The objects and advantages of the invention may be realized and attained by means of the instrumentalities, combinations, compositions, and methods particularly pointed out in the appended claims.

To achieve the foregoing and other objects and in accordance with the purposes of the present invention, as embodied and broadly described therein, the apparatus of this invention may comprise a closure device in fluid communication with a pressure differential valve which is normally in the closed position until a pressure is exerted on the valve wherein the pressure is great enough to force the valve open.

BRIEF DESCRIPTION OF THE DRAWINGS

The accompanying drawings, which are incorporated in and form a part of the specification, illustrate the preferred embodiments of the present invention, and together with the description serve to explain the principles of the invention.

In the Drawings.

DETAILED DESCRIPTION OF THE PREFERRED EMBODIMENT

Figure 1:
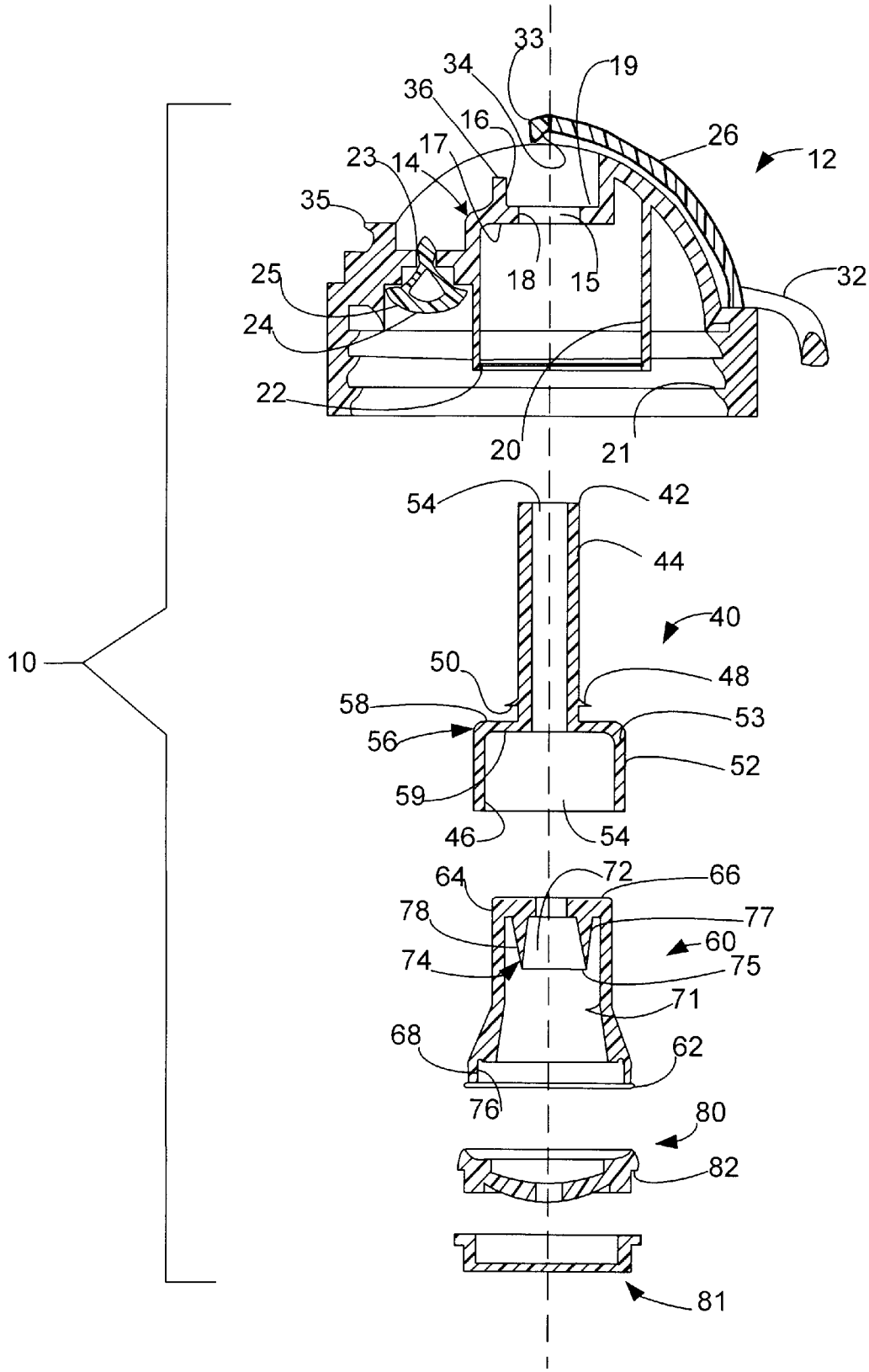
FIG. 1 is an exploded, side elevation view of the bottle cap of the present invention.
Figure 2:
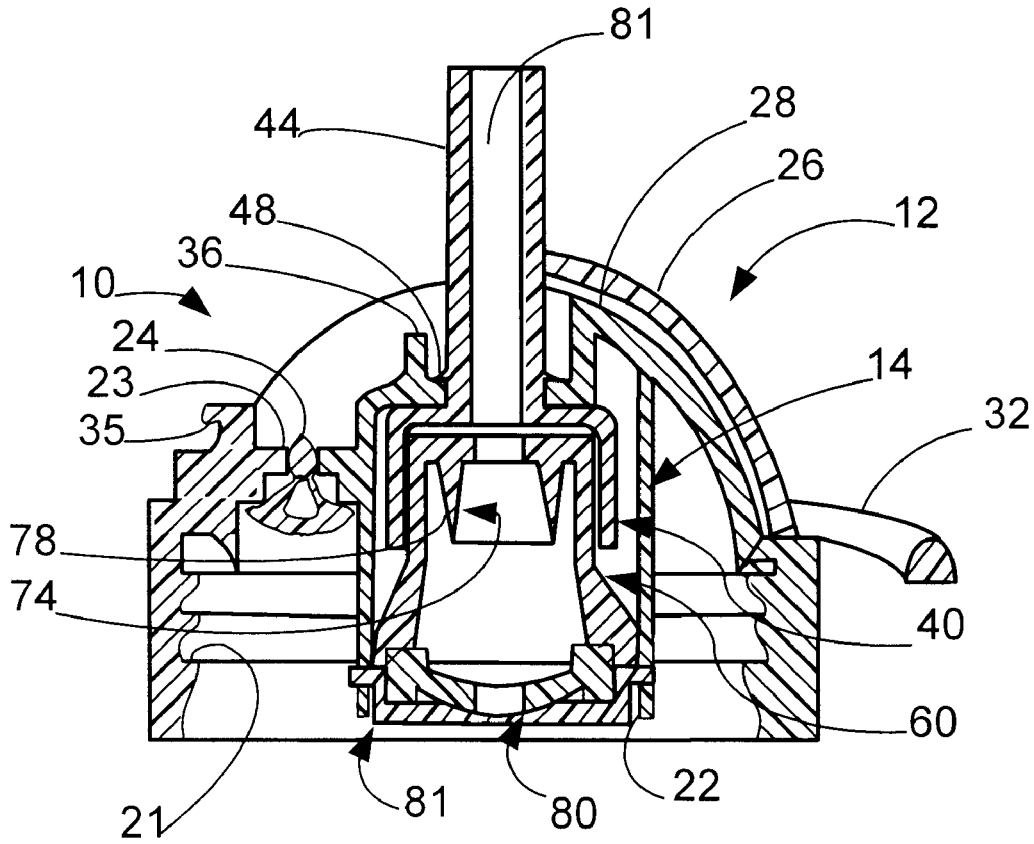
FIG. 2 is a side elevation view of the bottle cap of the present invention.
Figure 3:
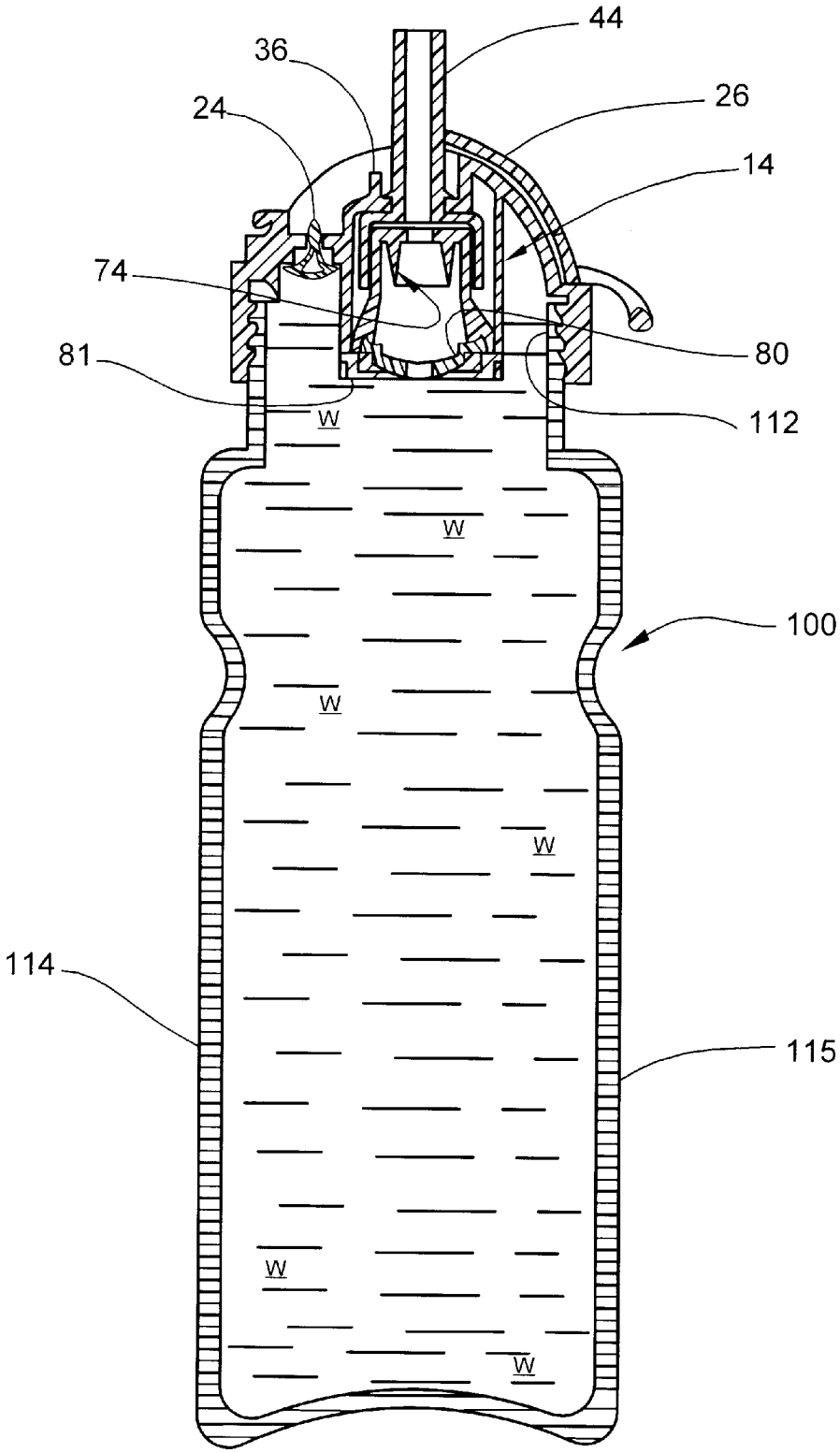
FIG. 3 is a schematic cross-sectional side elevation view of the bottle cap of the present invention attached to a container.
Figure 9:
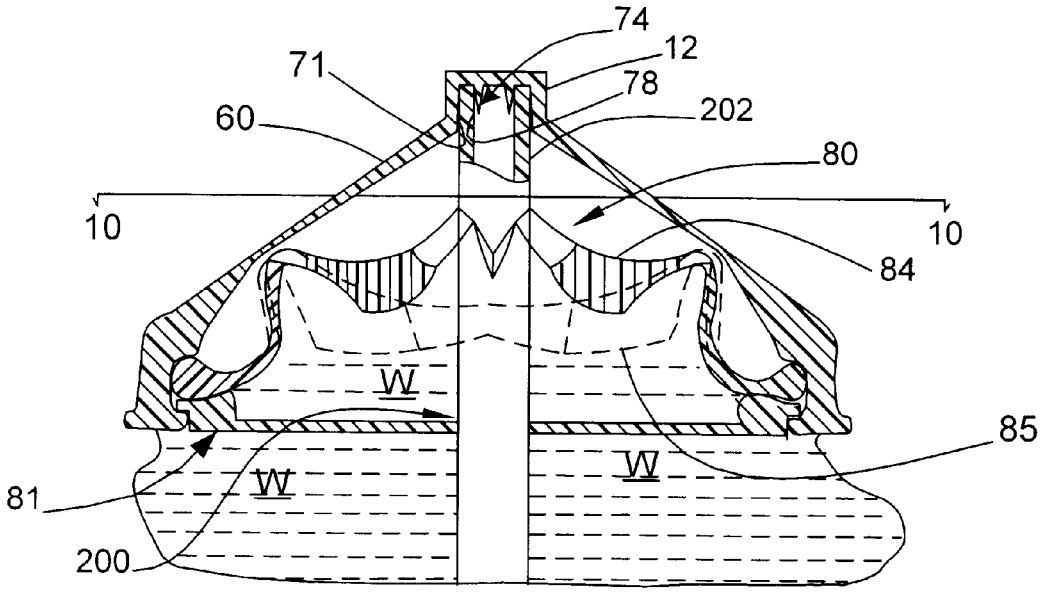
FIG. 9 is a cross-sectional view of the pressure differential valve used in the present invention installed in an associated container, with the valve shown in a fully open, and fully extended position, wherein the valve head portion which is shown snapped fully outward has a straw-like tube threaded through the opening.

The bottle cap 10, according to this invention, is best illustrated in FIGS. 1 and 2 and comprises a domed cover 12 which irreversibly engages straw housing 40 which in turn irreversibly engages straw receptor 60 and pressure differential valve 80 thereby forming bottle cap 10 which fastens to and seals bottle 100 (FIG. 3). Each individual element comprising bottle cap 10, that is, the domed cover 12, straw housing 40, straw receptor 60 and pressure differential valve 80 are shown separated from one another in FIG. 1, to illustrate their individual structures and will be discussed in further detail below. Furthermore, these individual structures are all constructed so that the bore of each element, when bottle cap 10 is fully assembled, forms a concentric channel 81 which thereby allows fluid flow through one single channel 81 between the inside and the outside of the bottle 100. In operation this unique bottle cap 10 structure allows the user to dispense fluid from within the bottle 100 in two different ways. The first manner of use, which will be described in further detail below, allows liquid to be dispensed only when bottle 100 (shown in FIG. 3) is inverted and squeezed. Squeezing causes the pressure to increase on the inside of the bottle thereby causing valve 80 to open and liquid to exit; however, when bottle 100 is not squeezed valve 80 remains in the closed position sealing bottle 100. The second manner of use, which is also described in further detail below, allows the user to convert bottle cap 10 for use as a sports mug having a straw-like tube to draw the liquid out of bottle 100. This configuration (shown in FIG. 9) is accomplished simply by threading a straw 200 through valve 80, thereby disengaging valve 80, and attaching the first end 202 of the straw 200 to the straw receptor 60. Bottle cap 10 is then attached to bottle 100 and the user can suck on the distal end 42 of straw housing 40 which is in fluid communication with the first end 202 of the straw 200.

Referring now to FIG. 1, the domed cover 12, is preferably, but not necessarily molded from a rigid plastic material and includes an air return valve 24, a retractable cover 26 and an elongated sleeve 14. Elongated sleeve 14 protrudes transversely downward from within the top of the domed cover 12 and has a sleeve bore 15 extending longitudinally there through. The upper end of sleeve bore 15 has a larger diameter end portion 16 and a larger diameter lower end portion 20. These upper and lower end portions 16 and 20, respectively, flanking sleeve bore 15 result in the creation of an annular shoulder 18 having a seating surface 19 and a lower surface 17 extending radially inward from sleeve 14 for securing flange 48 of straw housing 40 when the straw housing 40 is assembled within the sleeve 14 as shown in FIGS. 1 and 2.

Retractable cover 26 is pivotally moveable about an axis 30 over stationary portion 28. The pivotal arrangement can be achieved by axle pins 37 and 37' formed on the outside of the stationary portion 28 and reaching into the openings 38 and 38', respectively, in the retractable cover 16 or in the alternative axle pins (not shown) may be formed on the inside of retractable cover 16 and reach into openings formed in stationary portion 28. Domed cover 12 further comprises a handle 32 for carrying.

Straw housing 40 is preferably, but not necessarily molded from a flexible or elastic material, such as a silicone, and includes a truncated spindle shaft 52 with a smaller diameter elongated neck portion or drinking hose 44 extending from one end of the truncated spindle shaft 52. A shoulder 56 is formed where the larger diameter truncated spindle shaft 52 terminates into the straw portion 44. Straw housing 40 further has a flange radiating outwardly from the drinking hose 44 positioned immediately above shoulder 56 and a counter bore 54 that extends axially through the longitudinal length of straw housing 40. The inner diameter of counter bore 54 is greater in the spindle shaft 52 than within drinking hose 44. When straw housing 40 is assembled as shown in FIGS. 1 and 2, the surface 50 of flange 48 bears on seating surface 19 of annular shoulder 18 as the drinking hose 44 of straw housing 40 protrudes through the axial bore 15 in the upper portion of sleeve 14, and the upper surface 58 of shoulder 56 presses against lower surface 17. Consequently, the upper seating surface 19 provides longitudinal stability to straw housing 40 in sleeve 14, while the inner side wall surface 20 of sleeve 14 has an inner diameter which is equal to or greater than the outer diameter of the spindle shaft 52 of straw housing 40 positioned within and is thus capable of providing lateral stability to the straw housing 40 positioned within sleeve 14. The straw housing 40 is thus journaled for rotation in sleeve 14, but it is fixed against longitudinal and possibly transverse movement therein.

Straw housing 40 is further supported longitudinally and transversely by inserting the upper end of straw receptor 60 into counter bore 54 of spindle shaft 52 such that the upper surface 66 of straw receptor 60 sits flush with the lower surface 59 of shoulder 58. The outer diameter of the upper end of straw receptor 60 is equal to or slightly less than the inner diameter of spindle shaft 52 so that when assembled the sidewalls 64 and 46 of straw receptor 60 and spindle shaft 52, respectively, are flush. The lower end of sidewall 64 gradually flares radially outward until sidewall 68 is formed. Sidewall 68 has an outer radius equal to or slightly less than the inner radius of the inner sidewall surface 20, of sleeve 14, and terminates in a radially outward flared flange or rim 62 which fits or locks into an annular groove 22 positioned in sleeve 14, when straw receptor 60 is inserted into straw housing 40.

Straw receptor 60 is also preferably, but not necessarily, molded from a rigid plastic material and includes a tapered plug 74 which shares with straw receptor 60 a common axial counter bore 72 extending there through. The outer wall 78 of plug 74 is tapered so that its outer diameter increases from the lower end 75 to the upper end 77. Consequently, plug 74 will accommodate a variety of straw-like tubing having differing inner diameters. Conversely, the inner diameter of plug 74 decreases from the end 75 to the upper end 77. Consequently, it will accommodate a variety of straw-like tubing having differing outer diameters. It is this tapered plug 74 in combination with pressure differential valve.80 which allows the bottle cap 10 of the present invention to be used as a sports mug and this specific use will be described in further detail below.

Pressure differential valve 80 comprises an outer rim 82 which is seated in annular groove 76, as shown in FIG. 2, and further held in place by inserting retainer ring 79 into annular groove 76 thus sandwiching outer rim 82 of pressure differential valve 80 into place. The structure and operation of pressure differential valve 80 is fully disclosed in U.S. Pat. No. 5,439,143 which is incorporated herein by reference; however, valve 80 is germane to the operation of the present invention and consequently a fairly detailed discussion of how the valve operates is described below.

In operation, bottle 100 is filled with a liquid and the bottle cap 10 of the present invention is attached preferably by being screwed onto bottle neck 112 of bottle 100, thus forming an air tight seal. While bottle cap 10 as shown contemplates the use of threads 21 as a means of attaching bottle cap 10 to bottle neck 112, attachment may be accomplished through a number of other well known conventional manners known in the art, such as, through the use of a snap on lid which utilizes O-rings to form a seal. Once bottle cap 10 is securely attached to bottle neck 112 liquid within bottle 100 may be obtained by opening the retractable cover 26 and then inverting and squeezing bottle 100.

Referring primarily to FIGS. 2 and 17–19 retractable cover 26 is pivotally mounted about an axis 30 and is arranged on top of the stationary top portion 28 of the domed cover 12. The pivotal arrangement can be achieved by axle pins 37 and 37N, formed on the outside of the top portion 28 and reaching into openings 38 and 38N, respectively, formed in axial alignment in the retractable cover 26, or visa versa. The retractable cover 26 has a convex and circular shape that matches that of the stationary top portion 28. Also attached to the retractable cover 26 is a handle 32. Positioned such that when retractable cover 26 is in the closed position (FIG. 17) the handle is somewhat perpendicular to the axis 30 thereby allowing the user's fingers to carry the bottle 100. From the closed position the retractable cover 26 is pivoted to the open position (FIG. 19) and in doing so the drinking hose 44 stands up by itself.

The first contemplated use of bottle cap 10, that is, as a replacement for the push-pull valve, is described below. With the retractable cover 26 in the open position the plastic bottle 100 is inverted and water comes in contact with and interfaces with pressure differential valve 80 as shown in FIGS. 4–7. Pressure differential valve 80 has an integrally formed, one-piece construction. Valve 80 has an interior side 82 which interfaces with the fluid product or water, W in container 100 (FIG. 3), and an oppositely oriented exterior side 84 which interfaces with channel 81 of bottle cap 10 (shown in FIG. 2). Valve 80 is preferably molded from a resiliently flexible material, and in the illustrated example comprises a silicone which is substantially inert.

In operation, bottle 100 in combination with bottle cap 10, functions in the following manner. Valve 80 normally assumes the inwardly protruding orientation illustrated in FIG. 4 wherein valve 80 remains substantially in its original molded shape without deformation, with connector sleeve 87 being fully retracted and discharge opening 86 being fully closed. When valve 80 is mounted in the annular groove 76 of straw receptor 60 as is shown in FIG. 2, valve 80 is configured such that discharge orifice 86 will remain securely closed, even under the hydraulic head pressure applied thereto by the fluid product W when the bottle 100 is completely full (shown in FIG. 8).

When bottle 100, sealed with bottle cap 10 is inverted and squeezed, such as by manually flexing container sidewall 114 inwardly, connector sleeve 87 functions as a rolling diaphragm, and permits valve head 85 to begin shifting axially outwardly toward the straw receptor 60 by doubling over connectors sleeve 87, which then in turn, begins to extend outwardly in a rolling fashion, as illustrated in FIG.

5. The outwardly protruding J-shaped configuration of connector sleeve 87 assists in initiating this rolling motion of connector sleeve 87. The elastic deformation of connector sleeve 87 from its original molded shape (FIG. 4), generates a complex pattern of stresses within valve 80 which resiliently urges the same back into its original or normal configuration, which forces include an outwardly directed torque applied by connector sleeve 87 to valve head 85 adjacent marginal edge 88, which tends to resiliently urge discharge orifice 86 toward its open position, as described in greater detail below.

Figure 5:
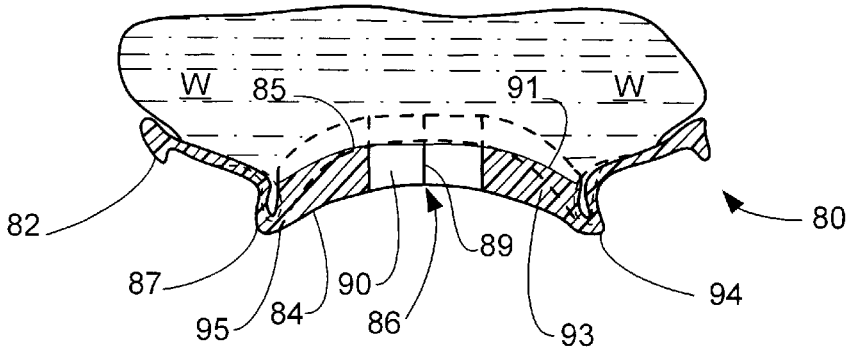
FIG. 5 is a cross-sectional view of the pressure differential valve used in the present invention installed in an associated container, with the valve shown in a fully closed, and fully extended position, wherein a valve head portion which is shown beginning to snap outwardly.

When additional pressure is communicated with the interior of container 100, as illustrated in FIG. 5, valve head 85 continues to shift axially outwardly by rolling connector sleeve 87 over upon itself. The marginal edge 88 of valve head 85 passes through the center of outer flange 84.

When additional pressure is communicated with the interior of container 100 valve head 85 continues to shift outwardly (as illustrated in FIG. 5). However, since connector sleeve 87 is fully extended, further outward shifting of valve head 85 longitudinally tenses or stretches connector sleeve 87, thereby increasing the outwardly directed torque applied to the valve head 85. Also, the further outward movement of valve head 85 tends to flatten or straighten valve head 85, particularly along the exterior surface 84 thereof, as best illustrated in the broken line figure in FIG. 6. This flattening motion tends to enlarge or dilate the circular plan configuration of valve head 85, which enlargement is in turn resisted by radially inwardly directed forces applied to the marginal edge 88 of valve head 85 by connector sleeve 87, thereby generating another complex pattern, of stresses within valve 80, which forces include those which tend to compress valve head 85 in a radially inward direction. Due to the tapered shape of valve head 85, the majority of compression strain is believed to take place adjacent the center portion 91 of valve head 85. As best illustrated by a comparison of the broken line figure and the full line figure provided in FIG. 6, when connector sleeve 87 is in the fully extended position, as shown in the broken lines, and additional pressure is communicated with the interior side 85 of valve 80, exterior rim 95 moves axially outwardly and radially outwardly as shown in the full lines of FIG. 6. The marginal edge 88 of valve head 85 is shown bent or elastically deformed inwardly as a consequence of the torque forces applied thereto by connector sleeve 87.

Figure 6:
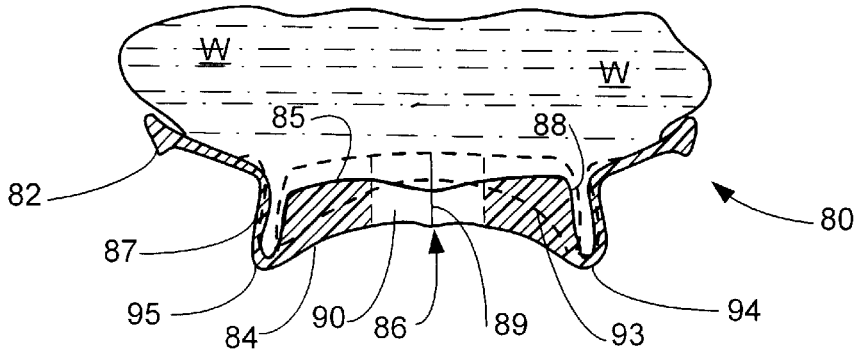
FIG. 6 is a cross-sectional view of the pressure differential valve used in the present invention installed in an associated container, with the valve shown in a fully closed, and fully extended position, wherein a valve head portion which is shown continuing to snap outwardly.
Figure 7:
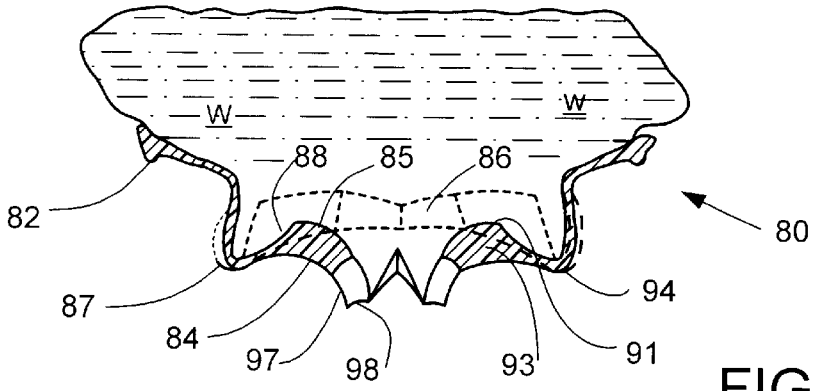
FIG. 7 is a cross-sectional view of the pressure differential valve used in the present invention installed in an associated container, with the valve shown in a fully open, and fully extended position, wherein the valve head portion which is shown snapped fully outward.

When additional pressure is communicated with the interior of container 100, as illustrated in FIG. 7, valve head 85 continues to shift outwardly by further longitudinal stretching of connector sleeve 87, and further enlargement of the plan shape of valve head 85. This motion is best illustrated by a comparison of the broken line figure and the full line figure provided in FIG. 7. Exterior rim 95 moved from the condition illustrated in FIG. 6, which corresponds to the broken line figure of FIG. 7, in an axially outwardly and radially outwardly fashion to the position shown in the full lines of FIG. 7. The marginal edge 88 of valve head 85 is shown more bent or elastically deformed inwardly, as a consequence of the increased torque forces applied thereto by connector sleeve 87. These combined forces and motions also serve to further compress valve head 85 into a state of bifurcation, as illustrated in FIG. 7, wherein the combined forces acting on valve head 85 will, upon application of any additional outward force on the interior side 85 of valve 80, cause the same to quickly open outwardly with a snapping motion to separate valve flaps 97 in the manner illustrated in FIG. 7, and thereby dispense water W through discharge orifice 86. Water W then flows through channel 81 and out through the top 42 of drinking hose 44. The bifurcation state of valve 80, as the term is used herein, is illustrated in FIG. 6, and defines a relatively unstable condition which valve 80 assumes immediately prior to opening into the fully open condition shown in FIGS. 7 and 8. As valve 80 passes through the bifurcation state shown in FIG. 6, the combined forces acting on valve head 85 are in a very temporary, unstable condition of equilibrium for a given moment, and then quickly shift valve head 85 into a generally convex shape, simultaneously opening orifice 86. In the bifurcation state shown by the full lines in FIG. 7, valve head 85 assumes the shape of a nearly planar disc, with exterior surface 84 cupped inwardly between rim 95 and flap edges 98, and interior surface 85 bent slightly outwardly toward the center of orifice 86.

The snap type opening of valve 80 is achieved, at least in part, by the torque exerted on valve head 85 by connector sleeve 87, which as noted in the example illustrated in FIG. 7, is sufficient to substantially distort the shape of the marginal edge 88 of valve head 85. When valve 80 assumes the fully extended and fully open position illustrated in FIGS. 7 and 8, valve flaps 97, as well as the associated rim portion 93 of valve head 85 are bent or elastically deformed outwardly, thereby permitting the rim 94 of valve head 85 to become smaller or constrict slightly. Valve flaps 97 tend to fold openly along lines extending between orifice slits 89 and 90. The continued radial inwardly compression applied to valve head 85 by connectors sleeve 87, in addition to the outwardly oriented torque applied thereto by connector sleeve 87, combine to keep discharge orifice 86 in the fully open position, even if the pressure communicated with the interior of bottle 100 is reduced. Hence, after discharge orifice 86 has been opened through the application of the predetermined opening pressure, that pressure which is required to maintain fluid flow through orifice 86 is reduced, or less than the threshold pressure, so as to provide greater dispensing ease and flow control. Since the resiliency of connecter sleeve 87 serves to resist the dilating action of valve head 85, and thereby compresses the same to achieve a snap open/snap close motion, if the resiliency of connector sleeve 87 is varied somewhat, such as by making connector sleeve 87 thicker or thinner, the amount or degree of snap action can be thereby adjusted for any specific application. Similarly the resilient strength of ring 86 can be adjusted to accomplish the desired snap action.

Figure 4:
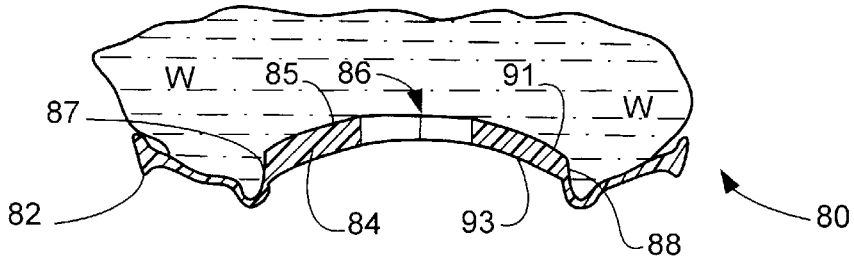
FIG. 4 is a cross-sectional view of the pressure differential valve used in the present invention installed in an associated container, with the valve shown in a fully closed, and partially extended position.
Figure 8:
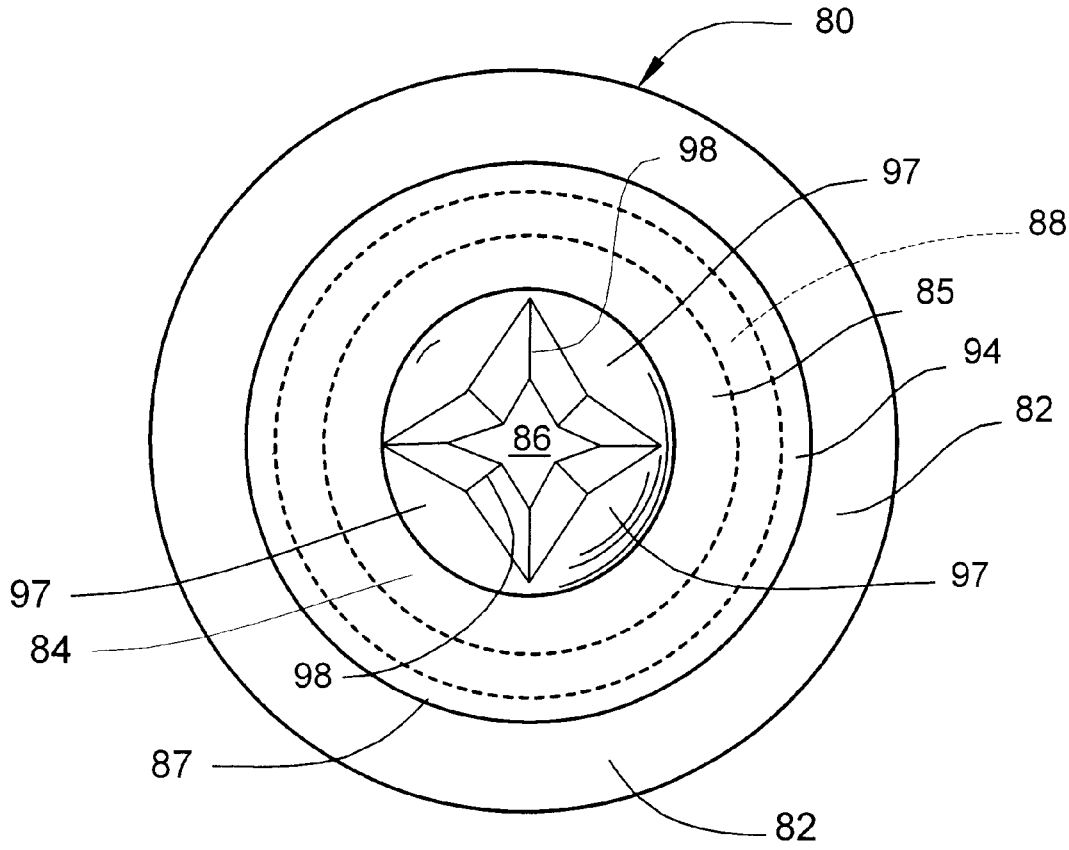
FIG. 8 is a bottom plan view of the pressure differential valve shown in the position illustrated in FIG. 7.

The combined compressive and torque forces acting on valve head 85 by connector sleeve 87 open valve flaps 92 to generally predetermined configuration, such that the rate of flow through discharge orifice 86 remains substantially constant, even though significant pressure differences are applied to bottle 100. As best illustrated in FIGS. 7 and 8, after valve 80 passes through the bifurcation state shown in FIG. 6, in the direction of opening, it quickly and positively assumes the fully open condition shown in FIGS. 7 and 8, wherein the flap edges 98 of valve flaps 97 diverge radially outwardly, such that discharge opening 86 assumes a star shaped plan configuration, as best seen in FIG. 8. The marginal edge 88 of valve head 85 rotates or pivots inwardly somewhat under the pressure of fluid product W, and the resilient torque applied thereto by connector sleeve 87, which continues to resiliently urge valve 80 back toward its original molded shape (FIG. 4). Connector sleeve 87 remains tensed both axially and circumferentially under outwardly directed forces generated by the pressures within bottle 100, as well as the dynamic flow of fluid product through orifice 86. The geometry of the illustrated valve 80, particularly in the shape of valve head 85 and connector sleeve 87, serve to force valve 80 into the configuration shown in FIGS. 7 and 8 whenever orifice 86 is snapped opened.

When pressure within the interior of bottle 100 is reduced, discharge orifice 86 will still remain open in substantially the fully open position shown in FIGS. 7 and 8, until the pressure reaches the preselected closure pressure, at which point, the forces developed in connector sleeve 87 through elastic deformation from its original molded shape (FIG. 4), pull valve head 85 inwardly, back through the bifurcation state, and into the concave orientation shown in FIG. 6, thereby positively and securely closing discharge orifice 86 with a snapping action, similar to that action by which discharge orifice 86 opened. The snap closing motion of valve head 85 serves to close orifice 86 very quickly and very completely, so as to sharply cut off the stream of fluid product being dispensed from bottle 100 without any drops or dribbles. Valve 80 will continue to assume the fully closed fully extended position illustrated in FIG. 7, until such time as the interior pressure in container 86 is further reduced, so as to permit the resiliency in connector sleeve 87 to shift valve head 85 back into the fully retracted, initial position illustrated in FIG. 4. Concurrently, with the closure of valve 80 air needs to be sucked back into the bottle. The air in this case passes through the air passage 23 which is fitted with a valve 24, preferably made of silicone or ethylene propylene (for example, "EPDM"). The preferable valve is an umbrella valve, however a number of other types of one way valves may be employed such as, but not limited to, duck bill valves.

The umbrella valve 24 is a one-way valve that remains collapsed flat against the bottom surface 25 of the air passage when the bottle 100 is squeezed, but opens easily as air pushes against it from the opposite direction as the bottle 100 is released. Essentially, it opens the same way an umbrella would inappropriately collapse if pointed away from the wind. Another advantage of the umbrella valve is that it quickly returns air into the bottle so that the user is able to drink rapidly without having to first wait for the air to return through the pressure differential valve 80, any filter being used or a straw tube if being used. Another advantage of the umbrella valve 24 is that it puts less stress on the bottle. As the bottle's memory returns it to its original shape, it must work against any obstruction in the air pathway.

Figure 17:
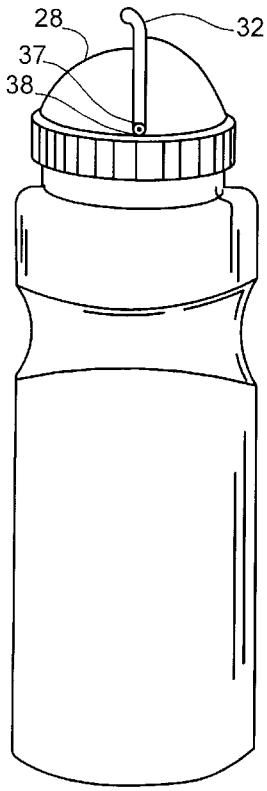
FIG. 17 is an isometric side view of a closed bottle cap of the present invention.
Figure 18:
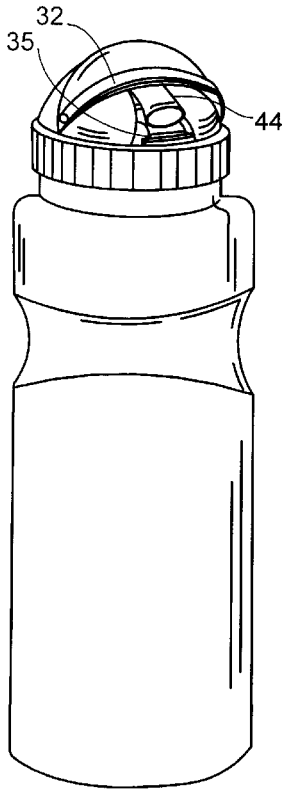
FIG. 18 is an isometric side/front view of the structure of FIG. 17 but with the bottle cap being partially closed.
Figure 19:
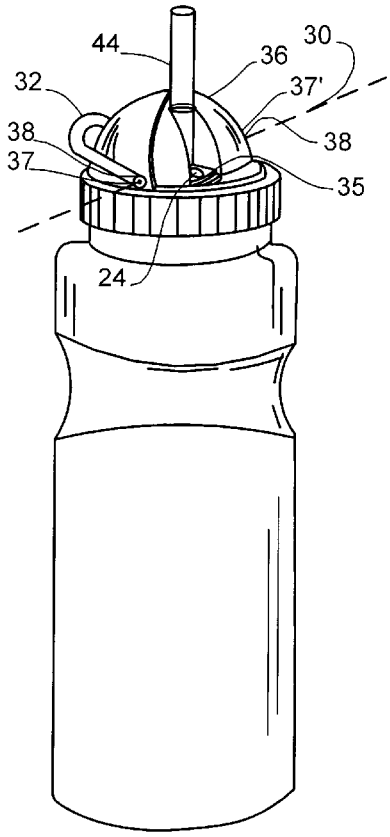
FIG. 19 is an isometric side/front view of the structure of FIG. 17 but with the bottle cap being fully opened.

After use, as shown in FIGS. 17–19, the user can then pivotally move the retractable cover 26 back to the closed position. In doing so the front edge 33 of retractable cover 26 comes in contact with the drinking hose 44 thereby bending the drinking hose 44 over the barrier 36. Thus the drinking hose 44 is closed with a relatively sharp bend therein. Drinking hose 44 is measured such that it has a length for fitting within the groove 39 in closed domed cover 12. To ensure that the retractable cover 26 is securely closed, a protrusion, or bump 34 (FIG. 1) is arranged on the leading edge of retractable cover 26 so that as retractable cover 26 is closed protrusion 34 snaps over a reciprocal protrusion 35 located on the base of bottle cap 12. Thus, bottle cap 10 can be opened and closed without the user's hands or fingers coming into contact with the drinking hose 44.

Figure 10:
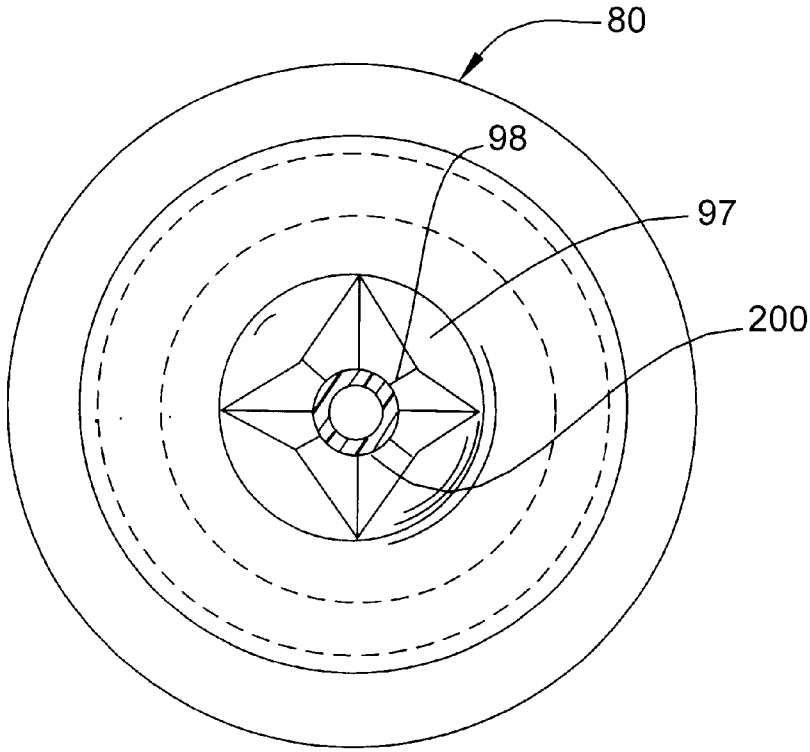
FIG. 10 is a bottom plan view of the pressure differential valve shown in the position illustrated in FIG. 9.

The alternative manner of using the bottle cap 10 of the present invention is to convert bottle cap 10 for use as a sports mug having a straw-like tubing. Prior to attaching bottle cap 10 to bottle 100 a straw 200 (shown in FIGS. 9 and 10) is threaded through the valve head 85 of pressure differential valve 80 and attached to the tapered plug 74 of straw receptor 60. In the particular embodiment shown in FIG. 9 the tapered plug 74 is inserted into the inner diameter of straw 200 and straw 200 is further secured by being wedged or pinched between the inner wall 71 of straw receptor 60 and the outer wall 78 of tapered plug 74. Valve flaps 98 hug the outer circumference of straw 200 thereby forming a seal around straw 200. In an alternative embodiment a straw having an outer diameter which is less than the outer diameter of tapered plug 74 can be inserted into the inner diameter of tapered plug 74. As discussed previously, the inner diameter of tapered plug 74 gradually decreases; consequently, as a straw is inserted within tapered plug 74 a friction fit is created thereby securing the straw. Pressure differential valve 80 is now deactivated by straw 200 and bottle cap 10 may be secured onto bottle 100. The user may then apply suction to the end of drinking hose 44 and draw liquid up and out of bottle 100.

Figure 11:
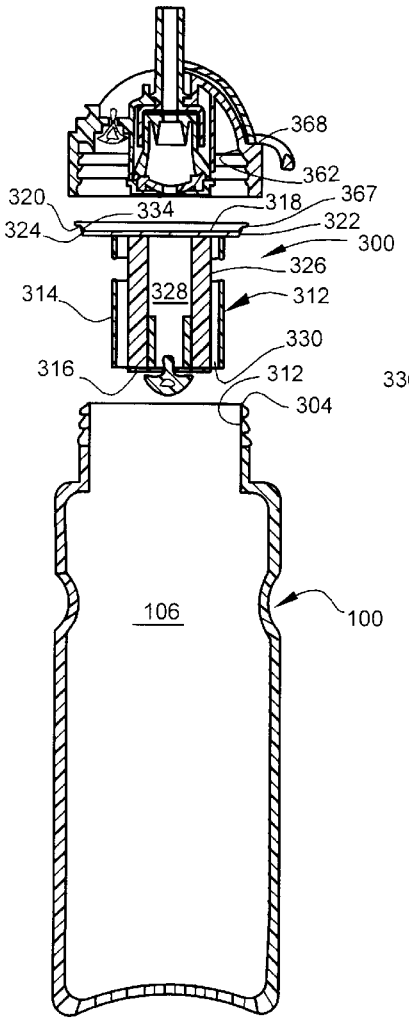
FIG. 11 is a schematic cross-sectional side elevation view of the bottle cap of the present invention, in position for attachment to a container that is receiving a filter element in its neck.
Figure 12:
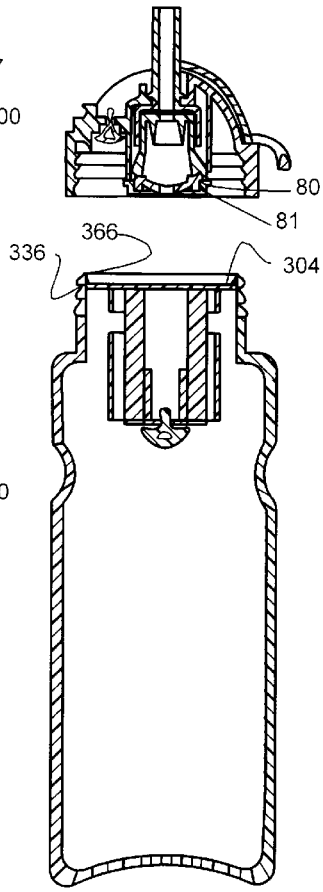
FIG. 12 is a schematic cross-sectional side elevation view of the bottle cap of the present invention, in position for attachment to a container having a filter element installed in its neck.
Figure 13:
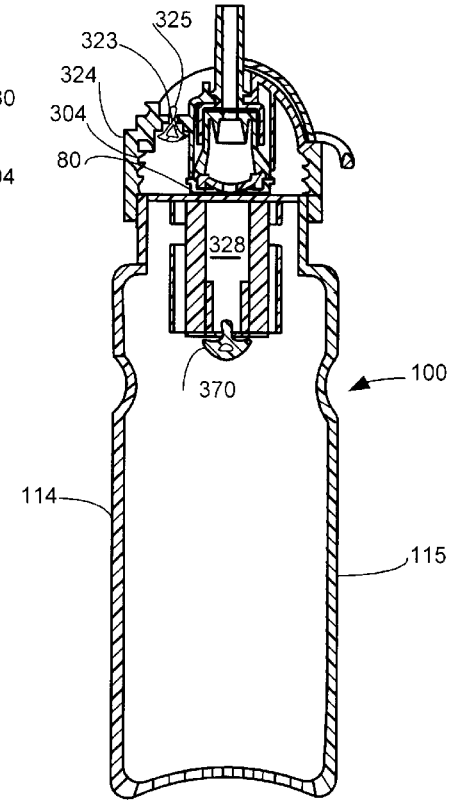
FIG. 13 is a schematic cross-sectional side elevation view of the bottle cap of the present invention, attached to a container having a filter element installed in its neck.
Figure 14:
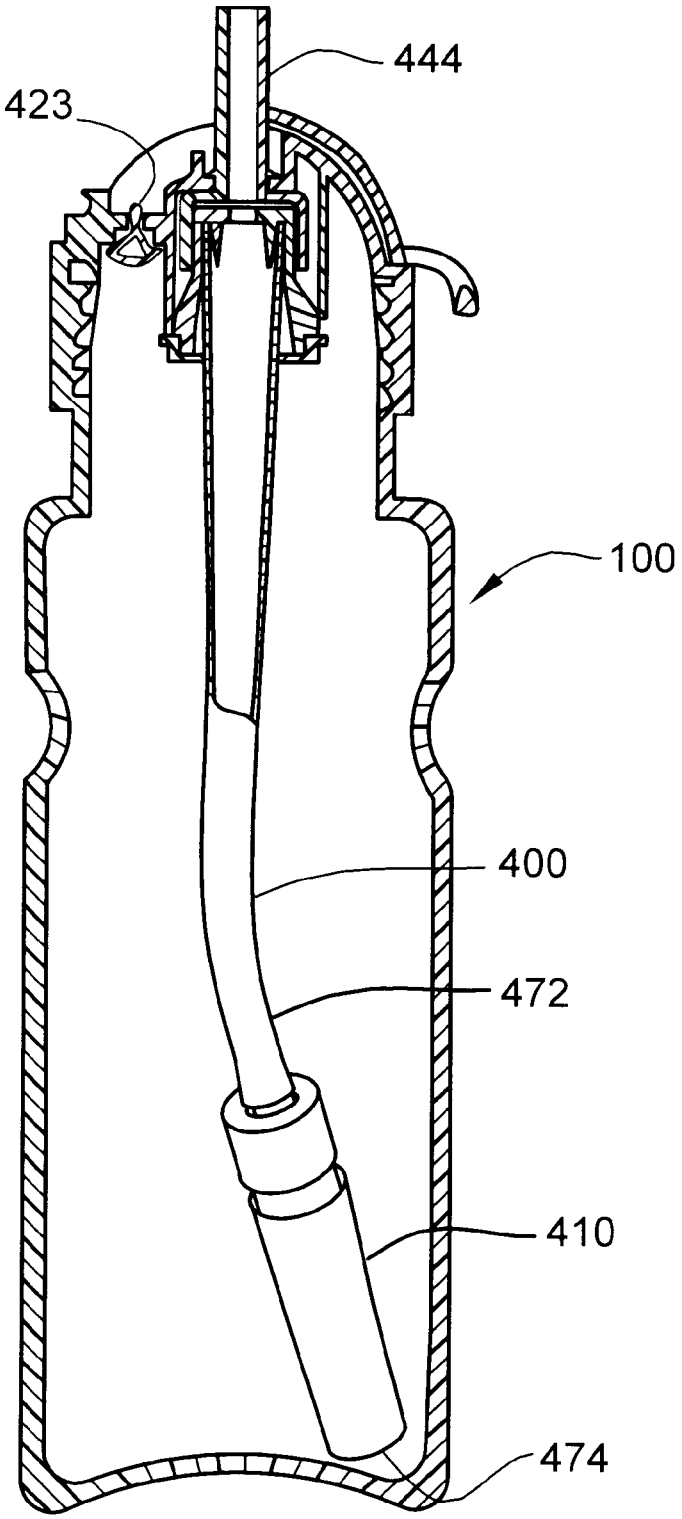
FIG. 14 is a schematic cross-sectional side elevation view of the bottle cap of the present invention, receiving a straw-like tube having a filter attached to the opposite end.
Figure 15:
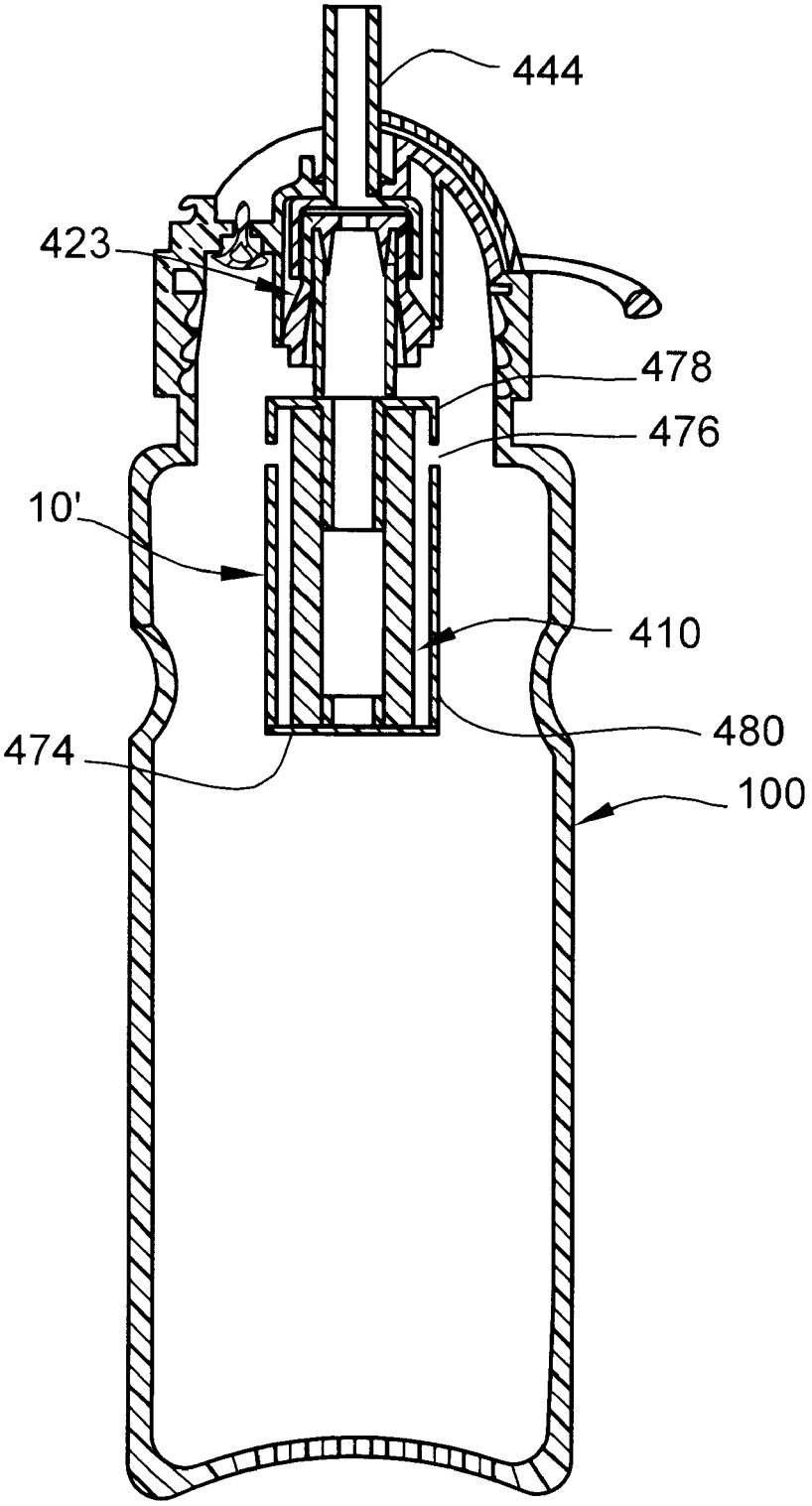
FIG. 15 is a schematic cross-sectional side elevation view of the bottle cap of the present invention having a filter attached directly to the straw receptor.

Referring to FIGS. 11–16, there are shown several, but not the only, embodiments of the bottle cap 10 of the present invention used in combination with a water filter. The water filter may be either installed in a bottle neck 312 (FIGS. 11–13), attached to a straw 400 for use in a bottle 100 (FIG. 14), attached directly to the straw receptacle 460 as shown in FIG. 15, or attached to sleeve 14. FIGS. 11–13 illustrate the filter 300 sealed in the neck 312 of a "typical sport" bottle 100. This preferred filter 300 is disclosed in U.S. Pat. No. 5,840,185 and is incorporated herein by reference.

Referring to FIGS. 11–13, the filter cartridge 300 comprises a media containment means, which is a generally-cylindrical cup 312 having a side wall 314, a bottom wall 316, and a lid 318. The upper portion 320 of the cup 312 acts as a securing means for holding the cup and media in a generally fixed position in the sports bottle once the bottle cap is installed. The upper portion 320 comprises a generally axial upending wall 322 and a generally radial flange 324 extending away from the axial centerline of the cup 312.

In use, water filter media 326 is placed inside the interior space of the cup 312. The filter media 326 may include solid, granular, or other materials. Conventional media support material, such as felt pads or mesh (not shown), may be included inside the cup 312 to support and/or contain the media.

The cup bottom wall 316 and lid 318 preferably have apertures for allowing water flow into and out of the interior space 328. Alternatively, other apertures besides the plurality of holes 330 may be included in the bottom wall 316 and the lid 318. For example, the bottom wall and lid may be formed of screen or other water-permeable material.

In use, the generally cylindrical cartridge 300 fits into the generally cylindrical neck 312 of the sports bottle 100, and is held in the bottle 100 by the cooperation of the flange 324 resting on bottle lip 304, shown in FIG. 12. Typically, the bottle is prepared for use by removing the bottle cap 10 and filter cartridge of the present invention, filling he bottle body 106 with water, inserting the cartridge 300 into the neck 302 and replacing the bottle cap 10 on the bottle. When the bottle 100 is tipped up for drinking, the water in the body 106 of the bottle flows through the bottom wall 316, through the media 326, out from the lid 318, and through channel 81 into the user's mouth.

The cartridge 300 (as discussed in detail in U.S. Pat. No. 5,840,185) is specially designed to cooperate with the bottle neck 312 and cap 10 to allow a water-tight seal between bottle neck 312, cartridge 300, and bottle cap 10 without requiring modification of the bottle 100 or cap 10. Several features particularly contribute the seal: the angle of the inner surface 334 of the upending wall 322, the thinness of the upending wall 322 at the connection between wall 322 and flange 324, the expandability of the upper wall 322, and the flexibility of the typical cap annular valve 362. First, the inner surface 334 of the upending wall 322 is formed at an angle of 10'–20' (preferably about 15') from vertical, or, in other words, about 15' from parallel to the longitudinal centerline of the bottle mouth and neck 312. Secondly, the upending wall preferably transitions from a thickness of about 0.062 inches to a thickness of preferably less than about 0.03 inches (preferably about 0.022 inches) in the region of the inner surface 334, so that only a thin wall rests between the cap annular valve seal 362 and the bottle neck. Thirdly, the upper portion 320 of the cup 312 is made of an expandable material such as high density polyethylene (HDPE) plastic or polypropylene, which allows the upending wall 322 to flex outward slightly as the bottle cap 10 is installed. Fourthly, the typical cap annular valve seal 362, protruding downward from the bottle cap 10 underside, is slightly flexible. Therefore, as the cap's annular valve seal 362 comes down and meets the upending wall 322, the annular valve seal 362 contacts the slanted inner surface 334 and is deflected slightly inward, by about 1/100 inch, and the upending wall 322 is slightly deflected outward towards the neck 352. Thus, the bottle cap 10 may be screwed down or otherwise lowered almost to the extent that it could be if the cartridge 300 were not in place.

When the bottle cap 10 is installed, as shown in FIG. 13, the flange 324 lies in between the cap and the lip 354 of the neck 352, and the upending wall 322 is positioned in between the side of the lip 354 and the annular valve seal 362. Thus, a tight seal is created by contact of the lip side surface 366 with the upending wall outer surface 336, and contact of the upending wall inner surface 334 with the outer surface 368 of the annular valve 362. Alternatively, the bottom surface of the flange 367 may seal against the lip top surface 369 to create or contribute to the neck-cartridge seal The flange 324 outer circumference is preferably slightly larger than the outer circumference of the lip 354. This creates a slightly overhanging edge to grasp with one's fingertips for removing the filter cartridge 300 from the bottle.

A slight draft in the manufacture of the cup side wall 314 is preferable for making the side wall 314 taper to a slightly smaller diameter at the wall bottom than the wall top. Especially in long-neck or narrow-neck bottle designs, this draft, preferably about 2–3 degrees, permits air to reach into the space between the cup side wall and the bottle inner wall, thus, making easier the insertion and removal of the filter cartridge.

Alternatively, other media containment means may be used besides the cup 312, for example, containment means that do not completely surround the media, but rather encircle or attach to media. For example, in the case of solid carbon block of media, the containment means could be an open ended cylinder or ring around the circumference of a cylindrical carbon block. A securing means such as the upper portion 320 may be attached to, or extend integrally up from, the cylinder or ring to secure the carbon block and cylinder or ring in the bottle.

In use in a plastic bottle neck, the filter 300 is inserted into the bottle neck as shown in FIGS. 11–13 and as described above. As the plastic bottle 100 is squeezed, water is purified as it is forced through the filter wall of the carbon block. As the user releases the bottle, it remembers its original shape and attempts to return to that shape. In doing so, the bottle sucks in air from the atmosphere. The air in this case passes through the straw tube and down through the center passage 328 and down to the bottom of the filter housing body 320, where it exits through an umbrella valve 370, preferably made of silicone or ethylene propylene (for example, "EPDM").

The umbrella valves 325 and 370 are one-way valves that remain collapsed flat against the bottom surfaces of air vent 326 and of the filter housing body when the bottle is squeezed, but opens easily as air pushes against it from the opposite direction. The use and position of this umbrella valve enables the carbon block filter 324 to be made with a is much tighter median pore diameter than it would if the path of air return were to self vent through the carbon block filter wall.

Another advantage of the umbrella valves are they allow for the quick return of air into the bottle 100 so that the user is able to drink rapidly without having to first wait for the air to return through the filter itself, known as self venting, and, second, to have to squeeze the water back into the carbon block pores each and every time another drink is taken. Another advantage of the umbrella valves 325 and 370 is that less stress is put on the pressure differential valve 380 and on the bottle 100 as a result of the quick return of air. As the bottle's memory returns it to its original shape, it must work against any obstruction in the air pathway. If the air were forced to return through the wall of the carbon block, it would put greater stress on the pressure differential valve 380 and plastic bottle 100.

FIGS. 14 and 15 demonstrate yet another method of filtering the liquid when the pressure differential valve 480 has been deactivated for use as a sports mug. A filter 410 similar to the one described previously and disclosed in detail in U.S. Ser. No. 08/988,864 which is incorporated herein by reference may be utilized. In use as a "loose" filter for purifying liquid in the sports mug configuration the stem 472 or other straw attachment port of the housing top is pushed into the end of a straw 400 (FIG. 14) and the combined straw-filter unit may be placed inside the bottle 100. Alternatively, the stem 472 of filter 410 may be inserted into the straw receptor 460 (FIG. 15) thereby deactivating pressure differential valve 80 the stem 472 of the filter lid which perforates the valve. As the user sucks on the drinking hose 444, the umbrella valve 470 flattens more firmly against the surface of the filter housing, so that the water flows through the inlets 474 in the housing body. For "air return," in an embodiment as shown in FIG. 14, air simply returns through the air vent 423 as discussed previously. In any case, when in use with a straw, the filter 410 may not need to provide for an air return.

In either inverted bottle-use or cup/mug use, the filter housing serves several functions. It cosmetically covers the carbon block, protects the carbon block, and provides a means for holding the carbon block in place in the bottle neck. In addition, the filter housing also serves to define the water inlet points and to direct water and air flow. The preferable placement of the water inlets 74 is near the bottom of the housing body. These perforations in the housing body are in any variety of vents or openings, and maybe additionally located at the top of the housing body as well for use in the alternate embodiment. In this way, when the filter is used in the water inlets 74 are used in the bottom of a mug or cup, nearly all the liquid may be sucked up through the straw via the lower vents.

Additionally, as shown in FIG. 15, the filter 10' has an annular gap between 476 between the top portion 478 of housing 410 and the lower portion 480 which allows for passage of water when the bottle is inverted and plugged into the cap. When in a cup or mug, little or no air passes through the angular gap 410 and through the carbon filter even when the liquid level is below the angular gap 410 and so little or no effect of the angular gap 410 is noticed in the straw application and water is drawn up through vent 474.

Figure 16:
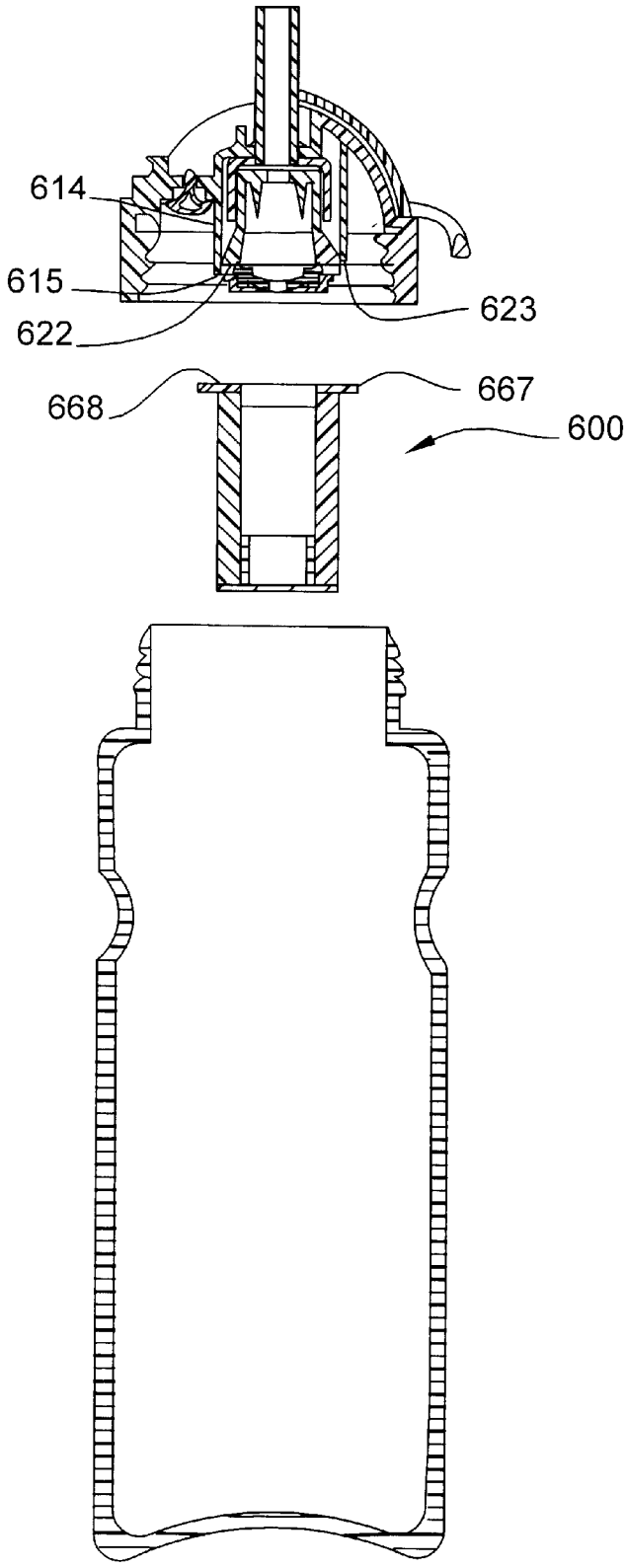
FIG. 16 is a schematic cross-sectional side elevation view of a bottle cap of the present invention which is in fluid communication with a filter.

FIG. 16 demonstrates an alternative embodiment of attaching filter 600 to bottle cap 10 of the present invention. A second angular groove 623 may be created below annular groove 622 for receiving flange 667 and holding filter 600 firmly in place. Alternatively, the top surface 668 of flange 667 may be affixed to the lip 615 of sleeve 614 by adhesives of welding such as spin welding.

The foregoing description is considered as illustrative only of the principles of the invention. The words "comprise," "comprising," "include," "including," and "includes" when used in this specification and in the following claims are intended to specify the presence of one or more stated features, integers, components, or steps, but they do not preclude the presence or addition of one or more other features, integers, components, steps, or groups thereof. Furthermore, since a number of modifications and changes will readily occur to those skilled in the art, it is not desired to limit the invention to the exact construction and process shown described above. Accordingly, all suitable modifications and equivalents may be resorted to falling within the scope of the invention as defined by the claims which follow.

The embodiments of the invention in which an exclusive property or privilege is claimed are defined as follows:

1. A bottle cap for liquid-holding containers comprising:

a main body having a bottom part for closing a container opening and a top part having, a first bore hole for receiving a straw housing, a second closable, air admitting bore hole, a sleeve bore in axial alignment with said first bore hole, said sleeve bore receiving said straw housing, and a two-way valve in fluid communication with said straw housing, wherein said straw housing has a first end, a second end and an axial bore wherein said first end has an outer diameter which is equal to or less than the diameter of said first bore hole and which is less than the outer diameter of said second end, wherein said first end extends through said first bore hole and said second end is received by said sleeve bore.

2. The bottle cap of claim 1, wherein said sleeve bore receives said two-way valve.

3. The bottle cap of claim 1, wherein said second end of said straw housing receives a straw receptor having a first end and a second end and an axial bore wherein said first end has a sleeve having a top end and a bottom end protruding downward which further shares said axial bore.

4. The bottle cap of claim 3, wherein said sleeve has an outer sidewall and an inner sidewall wherein said top end is connected to said first end of said straw housing and the outer sidewall from the top end to said bottom end tapers inward toward the axis of said axial bore.

5. The bottle cap of claim 4, wherein said inner sidewall of said sleeve from said top end to said bottom end gradually tapers away from the axis of said axial bore.

6. The bottle cap of claim 5, wherein positioned adjacent to said second end of said straw receptor is said two-way valve.

7. The bottle cap of claim 6, wherein said two-way valve is positioned within said second end of said straw receptor.

8. The bottle cap of claim 7, wherein a straw having a first and second end is threaded through said two-way valve and said first end is attached to said sleeve.

9. The bottle cap of claim 8, wherein said second end of said straw is attached to a filter.

10. The bottle cap of claim 7, wherein a filter is attached directly to said straw receptor.

11. The bottle cap of claim 10, wherein said filter is attached to said sleeve.

12. The bottle cap of claim 7, wherein a filter is threaded through said two-way valve and is attached to and seals said sleeve.

13. A drinking closure device for liquid-holding containers comprising (1) a main body having
  (i) a bottom part for closing a container opening and
  (ii) a top part defining a first and second bore hole wherein said first bore hole is in axial alignment with a sleeve;

(2) a straw housing wherein said straw housing has a first and second end and a counter bore in axial alignment with said first bore hole and said first end has an outside diameter equal to or less than the diameter of said first bore hole and said second end of said straw housing has an outside diameter that is greater than the diameter of said first bore hole wherein said sleeve receives and secures said straw housing; and (3) a straw receptor having a top and bottom end and a bore there through wherein said straw receptor is positioned within said second end of said straw housing so that said bore is in axial alignment with said counter bore of said straw housing and said top end comprises a sleeve protruding toward said bottom end and said bottom end receives a two way valve and contacts said sleeve of said main body.

* * * * *